US012259141B2

(12) United States Patent
Puoti

(10) Patent No.: US 12,259,141 B2
(45) Date of Patent: Mar. 25, 2025

(54) COMBINATION APPLIANCE

(71) Applicant: ELECTROLUX APPLIANCES AKTIEBOLAG, Stockholm (SE)

(72) Inventor: Eduardo Puoti, Forli (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 223 days.

(21) Appl. No.: 18/019,093

(22) PCT Filed: Dec. 7, 2020

(86) PCT No.: PCT/EP2020/084891
§ 371 (c)(1),
(2) Date: Jan. 31, 2023

(87) PCT Pub. No.: WO2022/028724
PCT Pub. Date: Feb. 10, 2022

(65) Prior Publication Data

US 2023/0280045 A1 Sep. 7, 2023

(30) Foreign Application Priority Data

Aug. 5, 2020 (EP) ..... 20189683

(51) Int. Cl.
*F24C 15/20* (2006.01)
*F24C 15/14* (2006.01)

(52) U.S. Cl.
CPC ..... *F24C 15/2042* (2013.01); *F24C 15/14* (2013.01); *F24C 15/2035* (2013.01)

(58) Field of Classification Search
None
See application file for complete search history.

(56) References Cited

U.S. PATENT DOCUMENTS 4,962,694 A 10/1990 Graver
6,455,818 B1 * 9/2002 Arntz ..... F24C 15/2042 126/299 R (Continued)

FOREIGN PATENT DOCUMENTS

DE 29709350 10/1997
DE 202009008286 9/2009

(Continued)

OTHER PUBLICATIONS

International Search Report and Written Opinion for PCT/EP2020/084891, dated Apr. 26, 2021, 10 pages.

(Continued)

*Primary Examiner* — Joseph A Dillon, Jr.
(74) *Attorney, Agent, or Firm* — Chrisman Gallo Tochtrop LLC

(57) ABSTRACT

The present invention is related to a combination appliance (10) A combination appliance (10) comprising a cooking hob (12) and an extraction device (14). The cooking hob (12) comprises a cover plate or worktop (22) having an opening (24) or a recess formed therein. The extraction device (14) is arranged below the cover plate or worktop (22) and comprises a fan (36) for sucking air from the area above the cooking hob (12) through the opening (24) or recess of the cover plate or worktop (22), a particle filter (52') for removing particles from the air sucked in, an odour filter (56) for removing odours from the air sucked in, and an outlet opening (30) for exhausting air. The particle filter (52) is arranged or arrangeable upstream of the at least one fan (36). According to a first aspect of the invention, the odour filter (56) is arranged or arrangeable upstream of the particle filter (52') and preferably downstream of the opening (24) or recess. According to a second aspect of the invention, an integrative particle filter element (52) is provided, which is a particle filter element (52) including odour filtering means (Continued)

(72). As an alternative to the integrative particle filter element (52) an integrative odour filter element or a common particle and odour filter element is proposed.

20 Claims, 4 Drawing Sheets

(56) References Cited

U.S. PATENT DOCUMENTS

| | | | | |
|---|---|---|---|---|
| 7,637,127 | B2 * | 12/2009 | Mills | D06F 43/085 68/12.02 |
| 7,687,748 | B2 * | 3/2010 | Gagas | F24C 15/2042 219/623 |
| 8,872,077 | B2 * | 10/2014 | Gagas | F24C 15/2042 219/622 |
| 10,788,222 | B2 * | 9/2020 | Froelicher | F24C 15/20 |
| 10,900,665 | B2 * | 1/2021 | Flesch | F24C 15/2035 |
| 11,033,847 | B2 * | 6/2021 | Adam | F24C 15/32 |
| 11,193,675 | B2 * | 12/2021 | Neunhäuserer | B01D 46/0041 |
| 11,592,188 | B2 * | 2/2023 | Bruckbauer | F24C 15/2042 |
| 11,732,901 | B2 * | 8/2023 | Kim | F24C 15/2042 126/299 R |
| 11,739,943 | B2 * | 8/2023 | McEvoy | F24C 3/08 99/324 |
| 11,885,505 | B2 * | 1/2024 | Chartrel | B01D 46/56 |
| 12,111,059 | B2 * | 10/2024 | Flesch | F24C 15/2042 |
| 2007/0023420 | A1 | 2/2007 | Gagas | |
| 2010/0163549 | A1 * | 7/2010 | Gagas | F24C 15/2042 219/622 |
| 2012/0204855 | A1 * | 8/2012 | Huber | F24C 15/2092 126/299 R |
| 2016/0296870 | A1 | 10/2016 | Mckechnie | |
| 2018/0207312 | A1 * | 7/2018 | Chiang | B01D 46/4245 |
| 2020/0094180 | A1 * | 3/2020 | Adam | F24C 15/32 |
| 2021/0310666 | A1 * | 10/2021 | Bruckbauer | F24C 15/2042 |
| 2022/0178552 | A1 * | 6/2022 | Flesch | F24C 15/2021 |
| 2023/0184442 | A1 * | 6/2023 | Bruckbauer | F24C 15/2042 126/299 D |
| 2023/0213209 | A1 * | 7/2023 | Leikam | F24C 15/2042 126/299 D |
| 2023/0280044 | A1 * | 9/2023 | Caso | F24C 15/2064 454/56 |
| 2023/0296263 | A1 * | 9/2023 | Puoti | F24C 15/2042 126/299 D |
| 2024/0085031 | A1 * | 3/2024 | Benold | A47J 36/38 |
| 2024/0102667 | A1 * | 3/2024 | Bariviera | F24C 15/2035 |
| 2024/0328631 | A1 * | 10/2024 | King | F24C 15/2092 |

FOREIGN PATENT DOCUMENTS

| | | |
|---|---|---|
| DE | 102008050723 | 4/2010 |
| DE | 202016003254 | 6/2016 |
| DE | 102016113867 | 2/2018 |
| DE | 102018212329 | 1/2020 |
| EP | 1575693 | 9/2005 |
| EP | 3290813 | 3/2018 |
| FR | 1156581 | 5/1958 |
| JP | 63150533 | 6/1988 |
| KR | 101586379 | 1/2016 |
| WO | 2019081271 | 5/2019 |
| WO | 2019096701 | 5/2019 |
| WO | 2019166249 | 9/2019 |

OTHER PUBLICATIONS

European Communication in related matter application No., 20189683.4, dated Nov. 18, 2024, 19 pages.

* cited by examiner

COMBINATION APPLIANCE

During the performance of cooking activities under use of a cooking hob, cooking vapours are generated, which are distributed over the cooking area. In order to avoid these cooking vapours to be spread throughout the entire kitchen space, an arrangement of an extraction device, particularly an extractor hood, is common. Said extraction device is operated in parallel to the cooking hob, thereby sucking in those cooking vapours in order to filter out particles and tiny droplets from the vapours and/or to blow the vapours to the outside of the building. While it has been common to arrange such an extractor hood above the cooking area, in recent years downdraft extraction devices have been finding a growing market. Such kind of extraction device is usually arranged below a worktop of the related cooking hob and it comprises at least one fan for sucking air from the cooking area through an opening or recess arranged in the worktop.

Commercial combination appliances with a downdraft extraction device usually operate with recirculating air, which is not extracted outside of the installation room or building, but is blown out into a kitchen cabinet or directly into the ambient air after it has been filtered. A common order of arrangement of devices is as follows: the air with cooking vapours is aspirated from the cooking zones above the worktop of the cooking hob through the opening or recess, subsequently passing a particle filter, e.g. a grease particle filter. Then, after having passed the fan, the conveyed air passes an odour filter before being blown out through an outlet opening. Due to the fact that the odour filter is arranged closed to the outlet opening, which is usually situated on a level of or in a plinth or the kitchen cabinet, service activities on the odour filter are naturally cumbersome.

There are also combination appliances known comprising a filter arrangement with the odour filter being placed between the particle filter and the fan. Particularly, such a downdraft extraction device is known from WO 2019/081271 A1 teaching a combination appliance including a cooking hob and said downdraft extraction device, which extraction device comprises an approximately cuboid filter carrier. Two flat grease filter elements are arranged on opposite sides, thereby forming sidewalls of the filter carrier and allowing filtered passage of the conveyed air towards allocated fans arranged downstream of each one of the two grease filter elements. Between each pair of grease filter element and allocated fan, an odour filter element is placed in a parallel arrangement to the respective flat grease filter element and is supported by a filter holder, which is a part of an air intake housing.

Also, the document WO 2019/096701 A1 discloses such a combination appliance, in which on odour filter element is arranged in airflow direction between a grease filter element and a fan. In order to provide a combination appliance with reduced noise emissions, the odour filter covers an air inlet opening of the fan, thereby dampening fan noise on their way upstream towards a suction opening on the worktop of the cooking hob.

Finally, also DE 10 2008 050 723 A1 describes and illustrates a combination appliance including a downdraft extraction device.

This document discloses a cooking apparatus comprising two or more cooking hobs forming a cooking hob unit. At least one extraction device is provided between two adjacent cooking hobs and/or at outer edges of the cooking hob unit for the extraction of cooking vapours. Upstream of a fan for sucking in the cooking vapours, an integrated filtering device, particularly including a metallic grease filter and a carbon filter, is provided. Said filtering device, specifically its carbon filter, is arranged in a way difficulty to access, for example for cleaning or replacement purposes.

It is an object of the present invention to provide a combination appliance comprising a cooking hob and an extraction device, which is designed in a way allowing a simplified access to a filter arrangement, specifically to an odour filter or odour filtering means thereof.

According to a first aspect of the present invention, a combination appliance comprises a cooking hob and an extraction device. The cooking hob includes at least one cover plate or worktop, which has an opening or a recess formed therein, particularly in or close to a central region thereof. The extraction device is arranged below the cover plate or worktop and comprises at least one fan for sucking air, in particular kitchen vapours, from the area above the cooking hob through the opening or recess of the cover plate or worktop. In order to release the air sucked in by the fan, an outlet opening is included for blowing out the air particularly into the ambient air. The extraction device has at least one particle filter and at least one odour filter. At least one of said particle filter and odour filter may include more filter elements that are arranged downstream behind each other, for example filter elements having different filter designs for different filtering purposes, e.g. with different filtering degrees. The particle filter is arranged upstream of the fan and may be configured to screen out any types of particles from the drawn-in air, but preferably at least a grease particle filter is used. The particle filter may be removable through the opening or recess. There may be a need to remove the particle filter from time to time for cleaning purposes, i. e. to remove particles from the filter surface filtered out of the drawn-in air, particularly in order to wash the filter in a dishwasher. If the particle filter may be worn or if a disposable particle filter may be used, the removed particle filter may be replaced by a new one. In order to provide a simplified access to at least the odour filter, this odour filter, according to the present invention, is arranged or arrangeable upstream of the particle filter. The odour filter may be arranged before, specifically above the opening or recess, which may then be covered by the odour filter, but preferably said odour filter is arranged or arrangeable downstream of the opening or recess. Such an arrangement of the odour filter favourably presents the odour filter in a convenient and user friendly access level.

The cooking hob may be of any type including electric or gas cooking hobs. In particular, an induction cooking hob is a part of the combination appliance. The cooking hob may further be an autarkic cooking appliance, particularly integrated in a countertop of kitchen furniture, or it may be part of a stove.

A top surface of the cover plate or worktop, which is accessible to a user of the combination appliance, may be used for putting cookware thereon, specifically in order to perform a cooking process. To this end, the cooking hob preferably comprises at least one heating element defining a cooking zone on the cover plate or worktop. The cover plate or worktop may be of any suitable design or material, but favourably it is made out of glass, notably of glass ceramics.

A particularly simplified access to the odour filter may be provided by a structure or design of the extraction device, which allows the odour filter to be removable through the opening or recess. That way, the user of the combination appliance only needs to gain access to the interior of the appliance through the recess or opening, preferably without any excessive disassembly of any housing parts.

Advantageously, the odour filter is configured to just filter out odours from the cooking vapours that pass through this filter, but allowing any particles, particularly grease particles, to penetrate. This characteristic of the odour filter is favourable with respect to avoidance of potential clogging.

At least one filter, in particular the particle filter, may be included in or supported by a filter carrier. The filter may be arranged vertically or horizontally in the filter carrier. One specific embodiment is characterized by an inclined filter, preferably a flat filter element arranged in the filter carrier in an inclined orientation.

A particularly preferred embodiment of the combination appliance according to the first aspect of the present invention is characterized by an odour filter, which is supported by the particle filter and/or by the filter carrier. The odour filter may be mounted or arranged unconnected to the particle filter and/or filter carrier, but preferably the odour filter is coupled with the particle filter and/or with the filter carrier. It may be advantageous if the odour filter and the particle filter form a filter unit.

The particle filter and/or the filter carrier may comprise support means for supporting the odour filter preferably in a defined position, which position may also be configured to force the airflow completely through this type of filter. Instead of the support means, or in addition to them, connection and/or engagement means may be included, which act on or interact with the odour filter and which may be an advanced instrument for securing said defined positioning.

A specific embodiment provides for support means or connection and/or engagement means, which comprise snapping means, clicking means and/or latching means. Additionally, or alternatively, the support means or connection and/or engagement means comprise a carrying device, which particularly includes fittings.

According to embodiments, the odour filter and the particle filter are surrounded by a frame, specifically by a common frame. Such a frame may allow a joint treatment of the odour filter and the particle filter only taking one touch. Moreover, there is only one reception fixture for the combined filter arrangement in e. g. a potentially included air channel or piping of the extraction device needed.

According to a second aspect of the present invention, a combination appliance comprises a cooking hob and an extraction device. The combination appliance may include, where applicable, any of the features of the above-described embodiments. The cooking hob includes at least one cover plate or worktop, which has an opening or a recess formed therein, particularly in or close to a central region thereof. The extraction device is arranged below the cover plate or worktop and comprises at least one fan for sucking air, in particular kitchen vapours, from the area above the cooking hob through the opening or recess of the cover plate or worktop. In order to release the air sucked in by the fan, an outlet opening is included for blowing out the airstream particularly into the ambient air. The extraction device comprises particle filtering means and odour filtering means. At least one of said particle filtering means and odour filtering means may include one or more filter elements that are arranged downstream behind each other, for example filter elements having different filter designs for different filtering purposes, e.g. with different filtering degrees. The particle filtering means is or are arranged or arrangeable upstream of the fan and may be configured to screen out any types of particles from the drawn-in air, but preferably at least a grease particle filter is used. The particle filtering means may be removable through the opening or recess. The odour filter, which may be a carbon based filtering means, is adapted to remove odours from the air sucked in. According to the invention, particularly a first direction thereof, the particle filtering means is an integrative particle filter element. Said integrative particle filter element is a particle filter element including odour filtering means, in particular odour removing or reducing properties and/or odour removing or reducing elements. According to a second direction of N the present invention, which is an alternative solution to the first direction, the odour filtering means is an integrative odour filter element. Said integrative odour filtering element is an odour filter element arranged upstream of the at least one fan, and the odour filter element includes particle filtering means, in particular grease particle filtering means. The particle filtering means may be or include particle removing or reducing properties and/or particle removing or reducing elements. Further, according to a third direction of the present invention, which is an alternative solution both to the invention in the first direction and to the invention in the second direction, the particle filtering means and the odour filtering means are integrated in a common particle and odour filter element. With anyone of the above-mentioned integrative concepts the odour filtering means are accessible in a simplified, convenient and user friendly access level.

A preferred embodiment of the combination appliance according to the second aspect of the present invention is characterized by an integrative particle filter element or an integrative odour filter element or a common particle and odour filter element, which is included in or supported by a filter carrier. Said filter carrier may be equally designed in a way similar or congruent to known embodiments of filter carriers, which are configured to include or support merely a single type filter element, e. g. a grease particle filter. That way, a model of a combination appliance that is currently on the market with a known filter concept, i. e. with a filter carrier including or supporting a grease filter element only, may be modified by implementing the inventive concept of the just described integrative filter concept without any efforts.

Along the same lines as for the odour filter and the particle filter according to the above-described first aspect, the integrative particle filter element, or the integrative odour filter element, or the common particle and odour filter element may be surrounded by a frame, specifically an integrative frame, allowing to jointly handle the particle filtering means and odour filtering means, specifically during a common movement. Moreover, a common support or mounting fixture may be provided.

According to specific embodiments of the present invention, either according to the above-described first aspect or according to the also earlier described second aspect, anyone of the odour filter, the particle filter, the integrative particle filter element, the integrative odour filter element, or the common particle and odour filter element is or are of a flat shape, in particular of a rectangular design.

The present invention according to the first or to the second aspect may be further designed by a recess or opening, which is covered by a lid or grid that is coupled, preferably detachably coupled, with the filter carrier. Additionally or alternatively to the coupling with the filter carrier, a coupling with at least one of the particle filter and the odour filter, or with the integrative particle filter element, or with the integrative odour filter element, or with the common particle and odour filter element may be realized.

The lid may be a cover element covering the opening or recess at least during the non-activated state of at least the extraction device in order to prevent articles or particles from falling into the opening or the recess. The lid may be arranged in a small distance, but in parallel to the cover plate or worktop of the cooking hob, just preventing a falling in from above, but allowing a lateral intake for the cooking vapours. Preferably, however, the lid prevents an entire intake during the non-activated state of the extraction device and is removably or pivotably arranged at the cover plate or worktop in order to be opened during an operational phase of at least the extraction device. If a grid is used instead of such a lid or cover element for entire coverage, larger items are prevented from falling into the opening or recess, but basically tiny items or fluids may find this way. To this end, in order to prevent an uncontrolled fluid penetration into the interior of the combination appliance, the grid may comprise guiding means for a controlled guiding of the fluid towards a defined destination, notably into a liquid collector arranged inside of the combination appliance.

A particularly preferred embodiment of the present invention provides for at least one of the particle filter and odour filter and/or the filter carrier or anyone of the integrative particle or odour filter elements or the common particle and odour filter element being removable after removal of the lid. A preferred alternative provides for a joint removal, i.e. the at least one of the particle filter and odour filter and/or the filter carrier or anyone of the integrative particle or odour filter elements or the common particle and odour filter element is removable in combination with the lid. This alternative solution may be advantageous with respect to a minimization of handling steps during service activities.

A particularly preferred embodiment of the present invention is characterized by a tool-free assembly and/or disassembly of at least the odour filter or the odour filtering means. This increases the ease of use during the operation of the combination appliance and promotes the user's preparedness for regular maintenance activities, particularly for cleaning or replacing filter elements or filtering means.

In order to further facilitate service or maintenance activities, an illumination element may be arranged in the opening or recess, preferably in or at the filter arrangement or the filter carrier. When illuminated, the illumination means provide a lighting of the filter surface for inspection purposes. That way, a degree of pollution, particularly any grease deposits on the filter surface or frame can be identified. Said illumination element is preferably an LED. The illumination element is particularly arranged in a way as to have a best illumination level as well as to keep the removability of the filter arrangement or filter carrier ensured. Preferably, the illumination element is configured to automatically switch on when the lid or grid is removed from the cover plate or worktop.

Novel and inventive features of the present invention are set forth in the appended claims.

The present invention will be described in further detail with reference to the drawings, in which FIG. 1 is a perspective view of a combination appliance comprising a cooking hob and a downdraft extraction device installed in a kitchen cabinet;

In all figures the same or equivalent part are marked with the same reference numbers.

Figure 1:
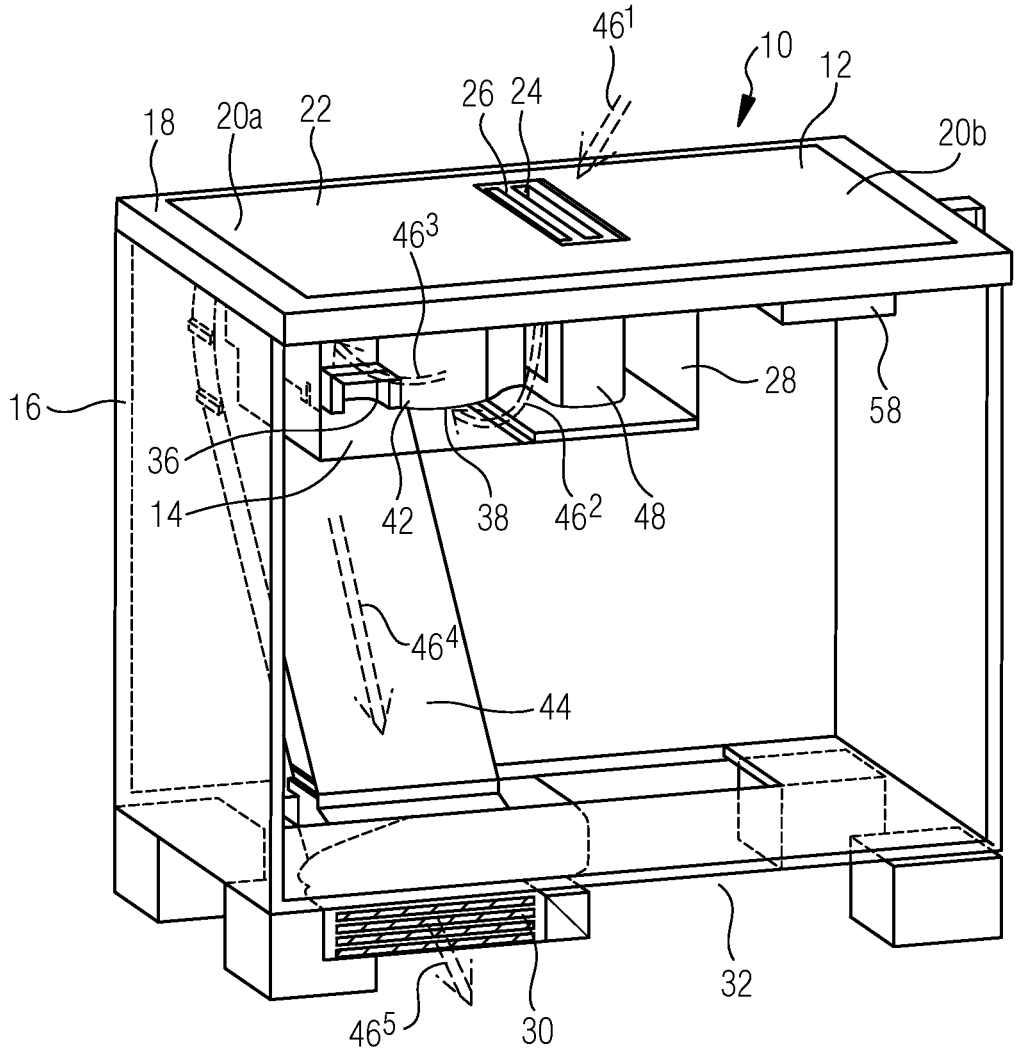

FIG. 1 illustrates a combination appliance 10 comprising a cooking hob 12 and a downdraft extraction device 14 installed in a kitchen cabinet 16. The cooking hob 12 is implemented in a cutout of a kitchen countertop 18 forming a top cover plate of the kitchen cabinet 16. The downdraft extraction device 14 is configured to take away cooking vapours occurring during cooking processes, in particular when cooking with uncovered cookware. The cooking hob 12 comprises cooking regions 20*a*, 20*b* arranged on a left half and a right half of a worktop 22 of the cooking hob 12, which left and right halves are separated from each other by a suction opening 24 for an intake of the cooking vapours, the suction opening 24 being arranged alongside a worktop centreline. The suction opening 24 is covered by a cover grid 26 for preventing items, e.g. cookware, to fall into the suction opening 24. Instead of the cover grid 26 a lid may be used for entirely covering the suction opening when the extraction device 14 is out of use, but for the operation of the extraction device 14 the lid is pivotable into an upright open position.

A casing 28 of the extraction device 14 is shown in FIG. 1 in transparent illustration. Said casing 28 provides a closed outer shell or first channel for a flow of the sucked-in cooking vapours on their way from the suction opening 24 to an exhaust opening 30 in a base area 32 of the kitchen cabinet 16. Said exhaust opening 30 is also covered, namely by an outlet grille 34.

The flow of the sucked-in cooking vapours through the extraction device 14 is driven by the operation of an extraction fan 36 arranged inside of the casing 28. Said extraction fan 36 comprises a bottom-sided intake opening 38 for sucking the cooking vapours from the interior space of the casing 28.

Figure 3:
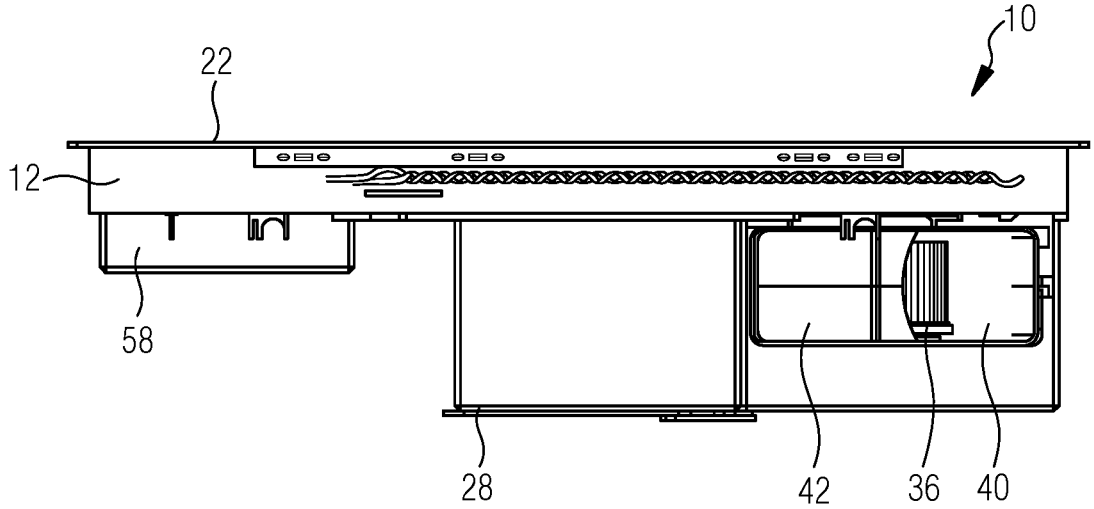
FIG. 3 is a rear view of the combination appliance of FIG. 2.

As illustrated by FIG. 3, which is a rear view of the combination appliance 10, a rear-sided fan outlet 40 is arranged for a horizontal exit of the air blown out backwards from the extraction fan housing 42. The fan outlet 40 is connected to a first end of an air duct 44 designed as a rectangular tube and forms a second channel arranged downstream the above-mentioned first channel. Directly at the passage from the fan outlet 40 to the air duct 44, an air duct bending by 90 degrees is implemented, which redirects the air flow from horizontal to vertical downwards. The air duct 44 may be guided alongside a rear side of the kitchen cabinet 16 and may be bent again by 90 degrees close to a rear lower edge of the kitchen cabinet 16 in order to direct the airflow towards exhaust opening 30 in the base area 32 of the kitchen cabinet 16. Accordingly, the second end of the air duct 44 is connected to the exhaust opening 30. The embodiment illustrated in FIG. 1 shows a solution of the air duct 44 with an inclined section of its downwardly directed portion, directed slightly to the right. Naturally, a solution with said portion arranged in an exact vertical direction is considerable as well.

The course of the cooking vapours from the cooking area through the extraction device 14 to a re-entry into ambient air is illustrated in FIG. 1 by dotted arrows $\mathbf{46}^1$ to $\mathbf{46}^5$. On their way through the extraction device 14, the cooking vapours pass through a filter assembly 48, which is arranged downstream directly behind the suction opening 24. Said filter assembly 48, which will be described in more detail further down below with reference to FIG. 5, includes a filter carrier 50 for providing a purification of the conveyed air.

Figure 2:
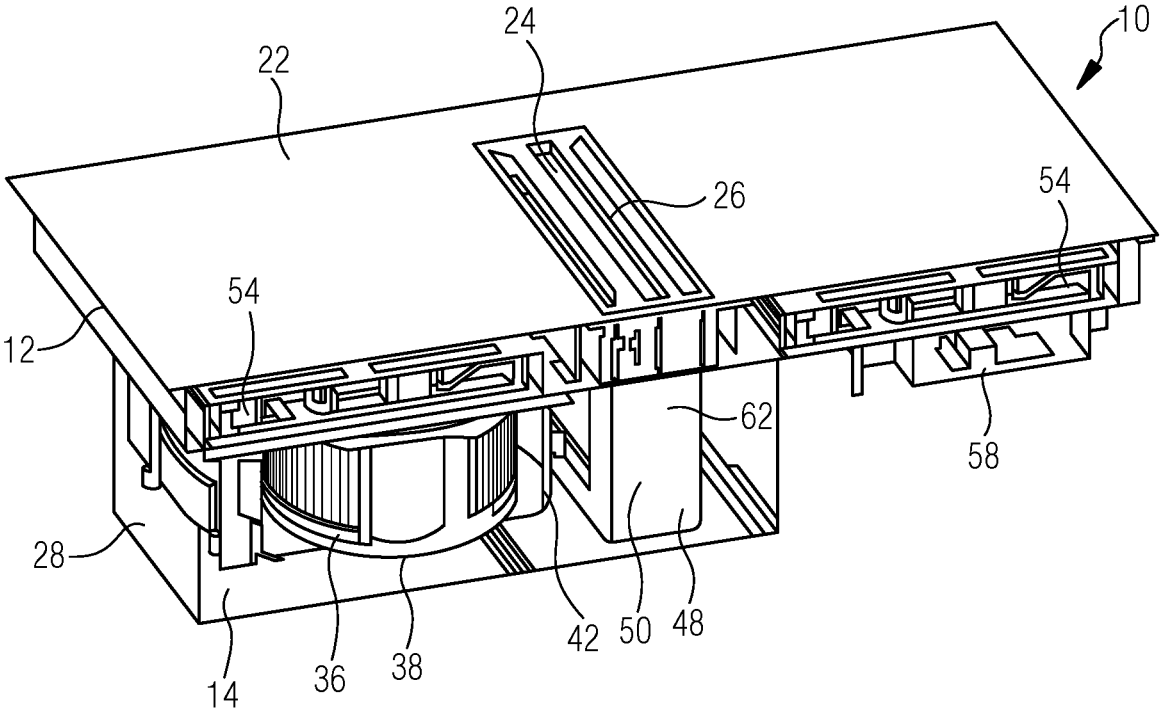
FIG. 2 is a cross-sectional perspective view of the disassembled combination appliance of FIG. 1 with a frontal surface cut away.

The cross-sectional view of FIG. 2 further shows two power boards 54, one for the left cooking region 20*a* and one for the right cooking region 20*b*, the power boards 54 providing cooking zones in the left and right cooking regions 20*a*, 20*b* with electrical power. In the present embodiment, the cooking hob 12 is an induction cooking hob and the cooking zones are defined by induction coils (not shown) that are arranged below the worktop 22 of the cooking hob 12. Attached to the bottom side of the power board 54 assigned to the right cooking region 20*b*, a further circuit board is arranged forming a control electronics 58 for the combination appliance 10.

Figure 4:
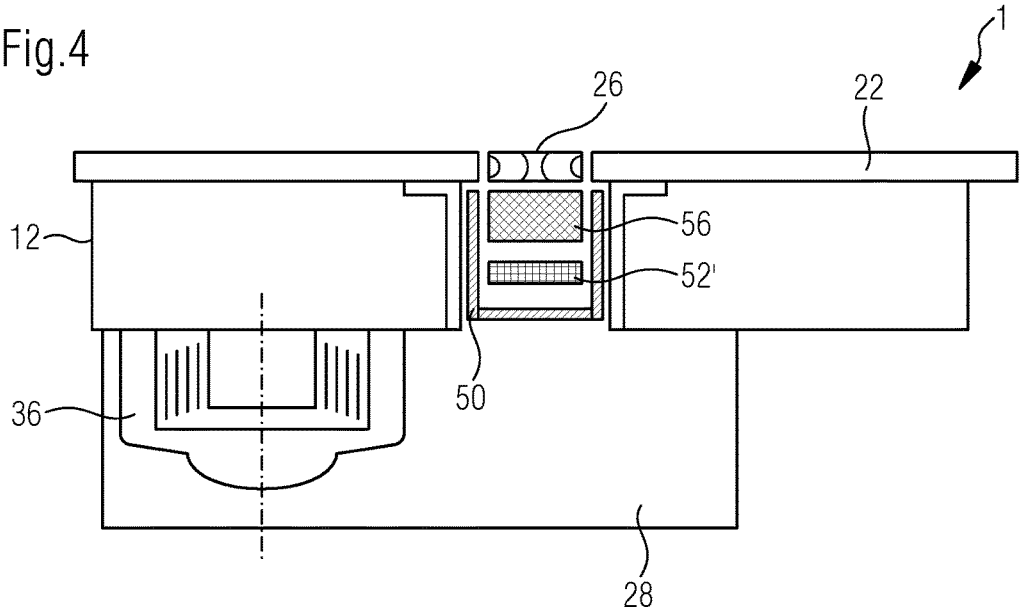
FIG. 4 is a schematic front view of the combination appliance of FIG. 2, but with a first example of a specific filter assembly.

FIG. 4 illustrates schematically a front view of a combination appliance 10 having a structure similar to that one of FIGS. 1 to 3. The extraction fan 36 and the filter carrier 50 are presented in a cross-sectional illustration. The filter arrangement of FIG. 4 forms a first example of the present invention. Within the filter carrier 50 a grease filter 52' is positioned in a horizontal orientation, so that the aspirated cooking vapours pass through the grease filter 52' in a direction orthogonally to the filter surface. On top of the grease filter 52' a carbon filter 56 for filtering out odours from the cooking vapours is arranged also in horizontal orientation. The carbon filter 56 may be supported by the grease filter 52', which itself is releasably fixed to the filter carrier, without any particular fixation. Naturally, the carbon filter 56 may also be fixed to the filter carrier 50 in a releasable manner, too, and may be spaced from the grease filter 52', as indicated in the schematic illustration.

Figure 5:
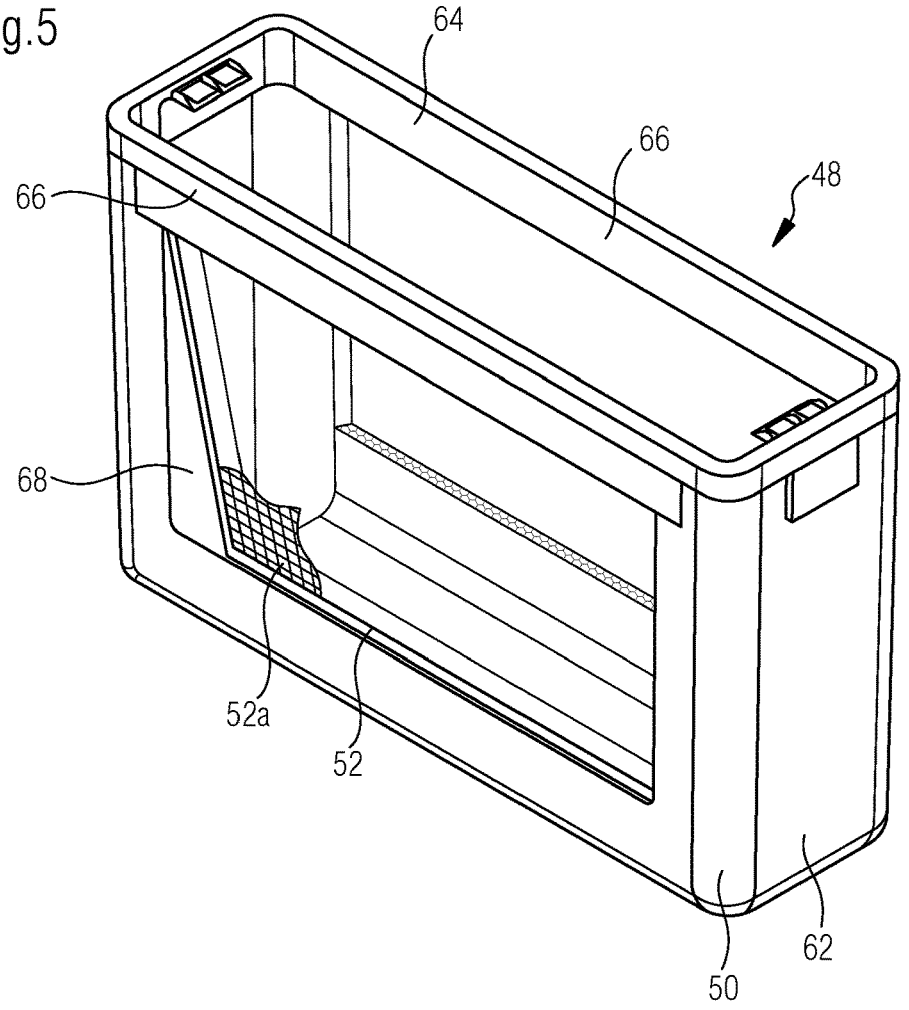
FIG. 5 is the filter carrier of the combination appliance of FIG. 2 in isolated illustration removed from the appliance including a second example of a specific filter assembly.

A second example of the inventive filter arrangement is presented by FIG. 5, showing the filter assembly 48 of FIG. 1 being removed from the suction opening 24 and shown in an isolated illustration. In order to remove the filter assembly 48, the cover grid 26 has to be removed prior to the removal of the filter assembly 48. However, according to a modification, the cover grid 26 and the filter assembly 48 may be coupled together, so that the filter assembly 48 may be removed together with the cover grid 26 in a single movement.

According to FIG. 5, a rectangular filter element 52 is arranged in and supported by the filter carrier 50. The filter carrier 50 includes a carrier housing 62 and a carrier frame 64, which are separable from each other. In an assembled state, the carrier frame 64 forms an upper face of the filter carrier 50 and, in that, covers the upper side of the carrier housing 62. The filter element 52 is detachably coupled to one of the longer frame parts 66 of the rectangular carrier frame 64, but removable from the carrier housing 62 when coupled with the carrier frame 64. The filter element 52 has a circumferential frame 60 surrounding a filter surface, which is indicated in FIG. 5 with a partial surface area by 52*a*. The filter surface 52*a* provides a purification of the conveyed air. The rectangular filter element 52 is arranged in the filter carrier 50 in an inclined orientation, which is favourable with respect to the airflow making a turn from a topside intake to a horizontal outlet.

As shown in FIG. 1 by dotted arrows $\mathbf{46}^1$ and $\mathbf{46}^2$, the flow of cooking vapours is conducted from the suction opening 24 and the open top side of the filter assembly 48 through the filter surface 52*a* before leaving the filter assembly 48 by penetrating the lateral surface 68 facing the fan 36. In order to provide an extensive passage for the airflow on its way out from the carrier housing 62, the lateral surface 68 is open to a great extent, which results in remaining merely a frame section of the lateral surface 68.

Figure 6:
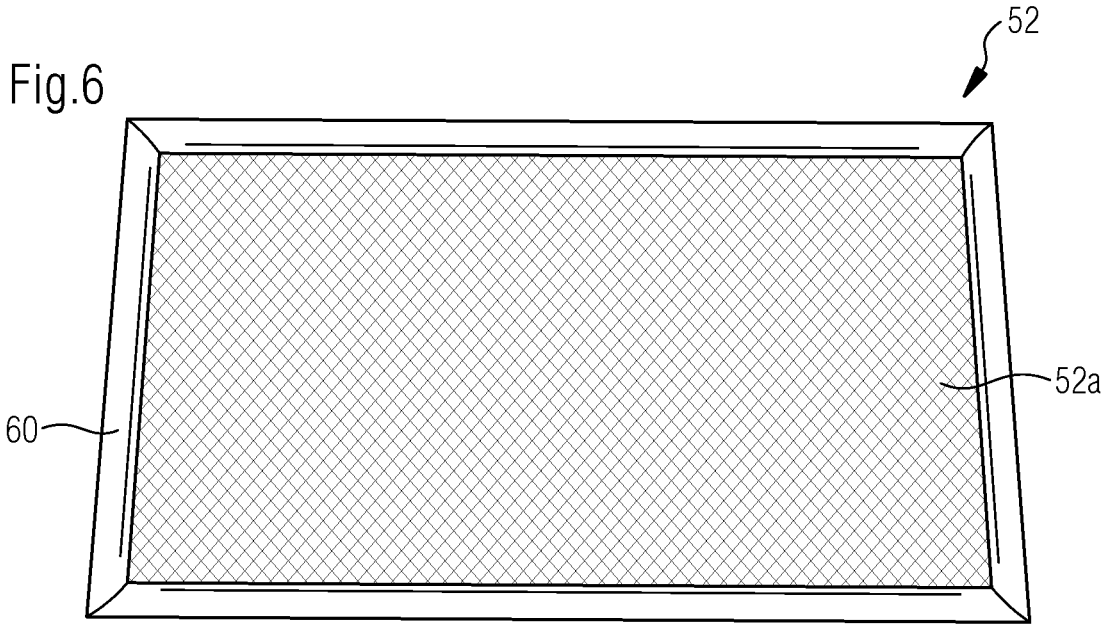
FIG. 6 is an example of a filter element in isolated illustration removed from the filter carrier of FIG. 5.

As already indicated before, not only the entire filter assembly 48 is removable from the suction opening 24, but also the filter 52 is removable from the carrier housing 62, specifically for cleaning and/or replacing purposes. FIG. 6 illustrates such an isolated filter 52, which is an integrative grease filter element, which is generally a particle filter element that includes odour filtering means. Such kind of odour filtering means particularly has odour removing or reducing properties or includes odour removing or reducing elements. As specifically indicated by FIG. 7, which illustrates an enlarged section of the filter element of FIG. 6, the particle filter element is formed by the filter surface 52*a* comprising grease filtering aluminium meshes 70 adapted to retain grease particles or droplets from the cooking vapours passing through the filter 52. The filter 52 includes two or more of parallel arranged filter surfaces 52*a* with grease filtering aluminium meshes 70, the at least two filter surfaces 52*a* providing a space in between them, thus forming a cage-like structure. Inside of said space, carbon spheres 72 are trapped and, due to the mesh-structure, the carbon spheres 72 are kept in place. To this end, the mesh size of the aluminium meshes 70 is smaller than the diameter of the carbon spheres 72. The carbon spheres are adapted to filter out odours from the cooking vapours. In summary, with the integrative filter element 52 both odours and grease particles or droplets are filtered out from the cooking vapours, so that the air passing through this filter 52 is purified in a way that the filtered air can easily be returned to the ambient air of the kitchen.

Figure 7:
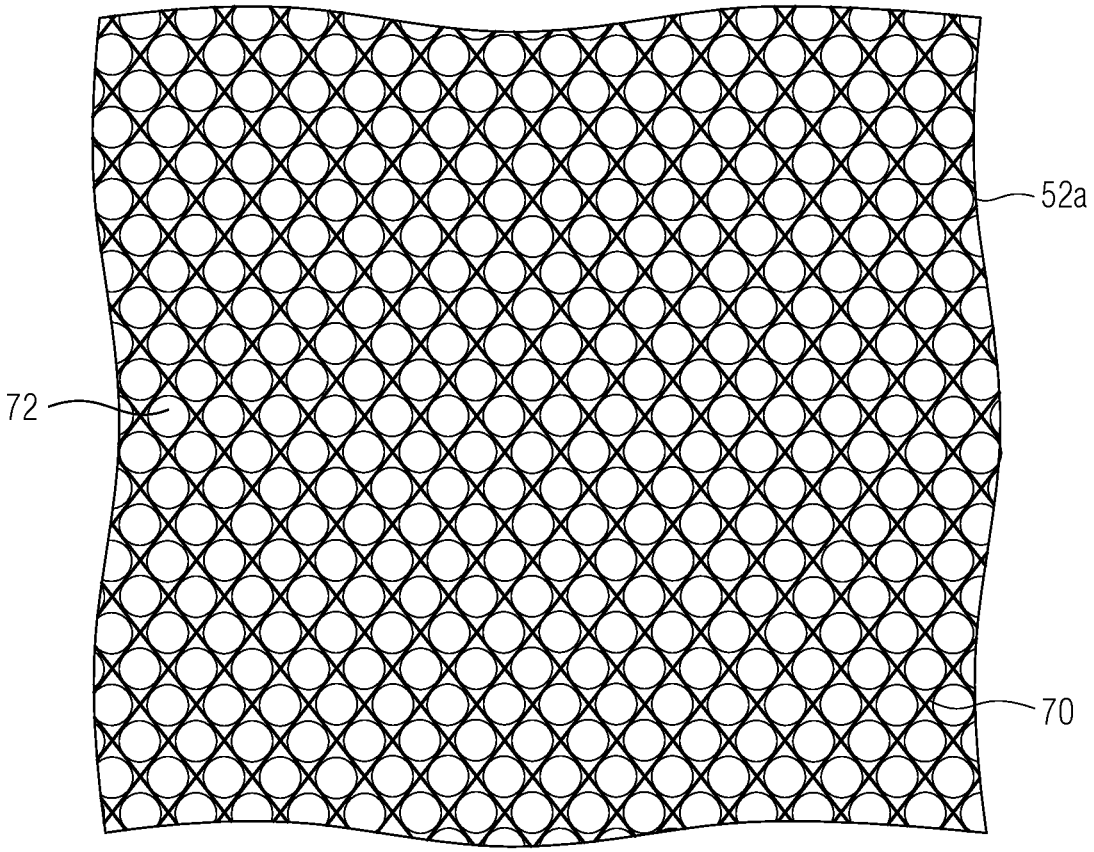
FIG. 7 is an enlarged section of the filter element of FIG. 6.

The integrative filter according to FIGS. 6 and 7 is only one possible representative for a combined or integrative filter for removing odours and grease particles from air passing therethrough. Alternatively to the above-described embodiment of carbon spheres 72 trapped inside the grease filtering aluminium meshes 70, a grease filter element integrally covered by or including an odour reducing tissue may be used. Another alternative is formed by a grease filter element with integrated carbon fibre reinforced plastic tissue.

Both above-described filter designs are washable, e. g. in a dishwasher, specifically the grease filter 52' according to the first example. Also the carrier housing 62 is separately washable after having been separated from both the extraction device 14, specifically from the suction opening 24, and from the filter 52 arranged therein.

Although illustrative embodiments of the present invention have been described herein with reference to the accompanying drawings, it is to be understood that the present invention is not limited to these precise embodiments, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 combination appliance
12 cooking hob
14 downdraft extraction device
16 kitchen cabinet
18 kitchen countertop
20*a*, 20*b* cooking regions
22 worktop

24 suction opening
26 cover grid
28 casing
28*a*, 28*b* first and second casing parts
30 exhaust opening
32 base area
34 outlet grille
36 extraction fan
38 intake opening
40 fan outlet
42 fan housing
44 air duct
46[1 to 5] arrows indicating air flow
48 filter assembly
50 filter carrier
52 filter
52' grease filter
52*a* filter surface
54 power boards
56 carbon filter
58 control electronics
60 frame
62 carrier housing
64 carrier frame
66 longer frame part
68 lateral surfaces
70 aluminium meshes
72 carbon spheres

The invention claimed is:

1. A combination appliance comprising:

a cooking hob, which comprises a cover plate or worktop having an opening or a recess formed therein, and an extraction device arranged below the cover plate or worktop, a fan adapted to suck air from an area above the cooking hob through the opening or recess of the cover plate or worktop, a particle filter adapted to remove particles from the air sucked in, which particle filter is arranged or arrangeable upstream of the fan, an odor filter adapted to remove odors from the air sucked in, and an outlet opening adapted to exhaust the sucked-in air into an ambient environment, wherein the odor filter is arranged or arrangeable upstream of the fan, upstream of the particle filter, and downstream of the opening or recess.

2. The combination appliance according to claim 1, wherein the odor filter is removable through the opening or recess.

3. The combination appliance according to claim 1, wherein the particle filter, is included in or supported by a filter carrier, the filter carrier being removable through the opening or recess.

4. The combination appliance according to claim 3, wherein the odor filter is supported by the particle filter and/or by the filter carrier.

5. The combination appliance according to claim 3, wherein the odor filter is coupled with the particle filter and/or with the filter carrier, the odor filter and the particle filter forming a filter unit.

6. The combination appliance according to claim 3, wherein the particle filter and/or the filter carrier comprise(s) support means or connection and/or engagement means acting on or interacting with the odor filter.

7. The combination appliance according to claim 6, wherein the support means or connection and/or engagement means comprise:

at least one of snapping means, clicking means and latching means, and/or a carrying device comprising fittings.

8. The combination appliance according to claim 1, wherein the odor filter and the particle filter are surrounded by a common frame.

9. A combination appliance comprising:

a cooking hob, which comprises a cover plate or worktop having an opening or a recess formed therein, and an extraction device, arranged below the cover plate or worktop, a fan adapted to suck air from an area above the cooking hob through the opening or recess of the cover plate or worktop, a particle filtering means adapted to remove particles from the air sucked in, which particle filtering means is arranged or arrangeable upstream of the fan, an odor filtering means adapted to remove odors from the air sucked in, and an outlet opening for exhausting the sucked-in air into an ambient environment, wherein:

the particle filtering means is an integrative particle filter element that includes the odor filtering means, or the odor filtering means is an integrative odor filter element arranged upstream of the fan and particle filtering means, or the particle filtering means and the odour filtering means are integrated in a common particle and odor filter element.

10. The combination appliance according to claim 9, wherein the integrative particle filter element or the integrative odor filter element or the common particle and odor filter element is included in or supported by a filter carrier.

11. The combination appliance according to claim 9, wherein:

the integrative particle filter element, or the integrative odor filter element, or the common particle and odor filter element is surrounded by a frame.

12. The combination appliance according to claim 1, wherein both the odor filter and the particle filter, or the integrative particle filter element, or the integrative odor filter element, or the common particle and odor filter element is or are of a flat shape.

13. The combination appliance according to claim 1, wherein the recess or opening is covered by a lid or grid that is detachably coupled with a filter carrier and/or with at least one of the particle filter and the odor filter, or with an integrative particle filter element that comprises odor-filtering means, or with an integrative odor filter element that comprises particle-filtering means, or with a common particle and odor filter element.

14. The combination appliance according to claim 1, wherein at least one of the particle filter and the odor filter and/or a filter carrier supporting both of the particle filter and the odor filter, or an integrative particle filter element comprising odor-filtering means, or an integrative odor filter element comprising particle-filtering means, or a common particle and odor filter element is or are removable either after removal of the lid or grid or in combination with removal of the lid or grid.

15. The combination appliance according to claim 1, wherein assembly and/or disassembly of at the odor filter can be done tool-free.

16. A combination appliance comprising:

a cooking hob having a cover plate adapted to support cookware for cooking food thereon and having an opening formed therein, and a cover adapted to fit within said opening and configured to inhibit passage of objects through said opening; and an extraction device arranged below the cover plate, the extraction device comprising:

a filter carrier arranged directly beneath said opening and comprising a carrier housing, said filter carrier being removably installable in the combination appliance through said opening;

particle-filtering means and odor-filtering means both removably supported by said filter carrier and removable from said combination appliance through said opening; and a fan having a downward-facing intake, said fan being configured to draw air from an area above the cover plate, through the opening therein, then through the particle- and odor-filtering means, and into an exhaust duct for recirculation of the drawn air back into an environment outside the combination appliance via an exhaust opening;

wherein said fan is located downstream of said filter carrier along a suction-airflow path of air drawn by the fan from above said cover plate through the opening and then out of the combination appliance through said exhaust opening; and wherein removal of said odor-filtering means for either cleaning or replacement thereof does not require any tools.

17. The combination appliance according to claim 16, said particle-filtering means comprising a particle filter that includes aluminum mesh, the particle filter being removably installed within the carrier housing, said particle filter further being adapted to filter particulates and/or droplets that pass through said opening in the cover plate and to accommodate passage of air therethrough; said odor-filtering means comprising a carbon odor filter that is supported by said filter carrier, the odor filter being disposed upstream of the particle filter along said suction-airflow path.

18. The combination appliance according to claim 17, further comprising an illumination element disposed adjacent to the filter carrier and configured to illuminate the particle filter and/or the odor filter so that either or both may be inspected through said opening when they are installed in the combination appliance, said illumination element being adapted to be activated when said cover is removed from said opening.

19. The combination appliance according to claim 18, said cover being adapted to permit passage of air drawn by said fan through said opening, and to inhibit passage of objects of predetermined size.

20. The combination appliance according to claim 16, said particle-filtering means comprising a particle filter that includes first and second aluminum meshes disposed parallel to and spaced apart from one another thereby defining a filtration space therebetween, said odor-filtering means comprising carbon spheres confined within said filtration space between the first and second aluminum meshes, thereby yielding a common filter element comprising both the particle- and odor-filtering means that is removably installed within the carrier housing.

* * * * *